United States Patent [19]

Yokoyama et al.

[11] Patent Number: 4,560,332

[45] Date of Patent: Dec. 24, 1985

[54] ROTARY VANE-TYPE COMPRESSOR WITH VANES OF MORE THERMALLY EXPANSIBLE MATERIAL THAN ROTOR FOR MAINTAINING SEPARATION OF ROTOR FROM HOUSING SIDE PLATE DURING HIGH TEMPERATURE OPERATION

[75] Inventors: Masato Yokoyama, Oobu; Eiichi Nagasaku, Chiryu; Tosiki Taya; Toshiyuki Kato, both of Kariya, all of Japan

[73] Assignees: Nippondenso Co., Ltd., Kariya; Toyota Jidosha Kogyo Kabushiki Kaisha, Toyota, both of Japan

[21] Appl. No.: 617,706

[22] Filed: Jun. 6, 1984

[30] Foreign Application Priority Data

Jun. 8, 1983 [JP] Japan ..... 58-102244

[51] Int. Cl.[4] ..... F04C 18/00; F04C 29/00

[52] U.S. Cl. ..... 418/83; 418/179; 418/255

[58] Field of Search ..... 418/83, 178, 179, 152, 418/255; 417/DIG. 1

[56] References Cited

U.S. PATENT DOCUMENTS

| | | | |
|---|---|---|---|
| 3,417,664 | 12/1968 | Brucker | 418/152 |
| 4,100,664 | 7/1978 | Straesser | 418/178 X |
| 4,144,005 | 3/1979 | Brucken | 418/255 |
| 4,242,065 | 12/1980 | Ishizuka et al. | 418/178 X |
| 4,255,098 | 3/1981 | Hertell | 418/82 X |
| 4,464,101 | 8/1984 | Shibuya | 418/178 X |

FOREIGN PATENT DOCUMENTS

| | | | |
|---|---|---|---|
| 21309 | 11/1969 | Japan | 418/179 |
| 132490 | 10/1981 | Japan | 418/178 |
| 151091 | 9/1982 | Japan | 418/179 |
| 67989 | 4/1983 | Japan | 418/179 |
| 124087 | 7/1983 | Japan | 418/152 |

*Primary Examiner*—William L. Freeh
*Assistant Examiner*—Paul F. Neils
*Attorney, Agent, or Firm*—Cushman, Darby & Cushman

[57] ABSTRACT

In a rotary vane-type compressor the rotor, the housing and the side plates are made of the same kind of material as one another. A plurality of vane grooves the length of each of which is as long as the thickness of the rotor is provided on the rotor. A set of vanes which is made of a different material than the rotor, more particularly a material the coefficient of thermal expansion of which is larger than that of the rotor, is received in the vane grooves in such manner that the end faces thereof face against the side plate. And the width of the vanes longitudinally of the rotor is determined as follows. The width is slightly less than the thickness of the rotor when the temperature there of is less than normal, but when the temperature becomes high the vane width becomes slightly greater than the thickness of the rotor because of the difference of the coefficients of thermal expansion.

6 Claims, 4 Drawing Figures

ROTARY VANE-TYPE COMPRESSOR WITH VANES OF MORE THERMALLY EXPANSIBLE MATERIAL THAN ROTOR FOR MAINTAINING SEPARATION OF ROTOR FROM HOUSING SIDE PLATE DURING HIGH TEMPERATURE OPERATION

FIELD OF THE INVENTION

The present invention relates to a rotary vane-type compressor adapted for use in an air conditioning apparatus, e.g. for a motor vehicle air conditioner.

BACKGROUND OF THE INVENTION

In general, a rotary vane-type compressor has a series of working chambers each defined by an outer peripheral surface of a rotor, side faces of two succeeding vanes, an inner peripheral surface of a housing and an inner surface of a side plate. Coolant gas is introduced into a working chamber while the volume of that working chamber is increasing. Then, the introduced coolant gas begins to be compressed and is discharged while the volume of that working chamber is decreasing. In a conventional compressor of this type, an end face of the rotor is closely juxtaposed with the inner surface of the side plate in order to avoid longitudinal movement of the rotor. However, according to the present inventors' observation, there is a drawback, in that material may deposit between the end face of the rotor and the inner surface of the side plate in this type of conventional compressor. The present inventors also have found the reason for this problem, as described below.

In order to avoid generation or reduction of a gap between the rotor, the housing and the side plate caused by thermal expansion thereof, all of the elements of a conventional compressor of this type usually are made of the same material, e.g., cast iron. Accordingly, the contact between the end face of the rotor and the inner surface of the side plate is a contact between bodies of the same material, and the tendency that a deposition is caused when there is contact between the same materials is known. It must be noted that merely changing of the material of the rotor or the side plate causes other problems, i.e., the thickness of the gap between the rotor and the side plate cannot be controlled.

In order to solve the above problem, at first, the present inventors tried making the width of the vanes longer than that of the rotor for using contacting only between the axially opposite end faces of the vanes and the inner surface of the side plate. Since the vanes can be made of a different metal material from that of the rotor deposition of material between the vanes and the side plate is not easily caused. Also, longitudinal movement of the rotor is controlled by the contact between the vanes and the side plate. However, in the modified compressor just described, the stress (total force/total area) on the side faces of the vanes becomes high because the area of the side faces of the vanes is small. And that makes the power needed for rotating the rotor high.

SUMMARY OF THE INVENTION

An object of the present invention is to solve above problems. Namely, an object of the invention is to avoid the deposition of material between the rotor and the side plate, without necessitating an increase in the power needed for rotating the rotor.

According to the present invention the rotor, the housing and the side plates are made of the same kind of material as one another. A plurality of vane grooves the length of each of which is as long as the thickness of the rotor is provided on the rotor. A set of vanes which is made of a different material than the rotor, more particularly a material the coefficient of thermal expansion of which is larger than that of the rotor, is received in the vane grooves in such manner that the end faces thereof face against the side plate. And the width of the vanes longitudinally of the rotor is determined as follows. The width is slightly less than the thickness of the rotor when the temperature there of is less than normal, but when the temperature becomes high the vane width becomes slightly greater than the thickness of the rotor because of the difference of the coefficients of thermal expansion.

According to the present invention longitudinal movement of the rotor is controlled by contact between the rotor and the side plate. Therefore, the stress on the rotor is so small that the rotor can be rotated using little power. Furthermore, since this situation pertains under normal temperature, the rotor and the side plate cannot fuse to each other.

On the other hand, when the temperature of the rotor and the vanes becomes high, the difference of the coefficients of thermal expansion therebetween makes the vanes project from the end face of the rotor to contact with the inner surface of the side plate. Since the materials of the vanes and the side plate are different from each other, a deposition therebetween is not caused even when the vanes contact with the side plate.

DESCRIPTION OF A PRESENTLY PREFERRED EMBODIMENT

Figure 1:
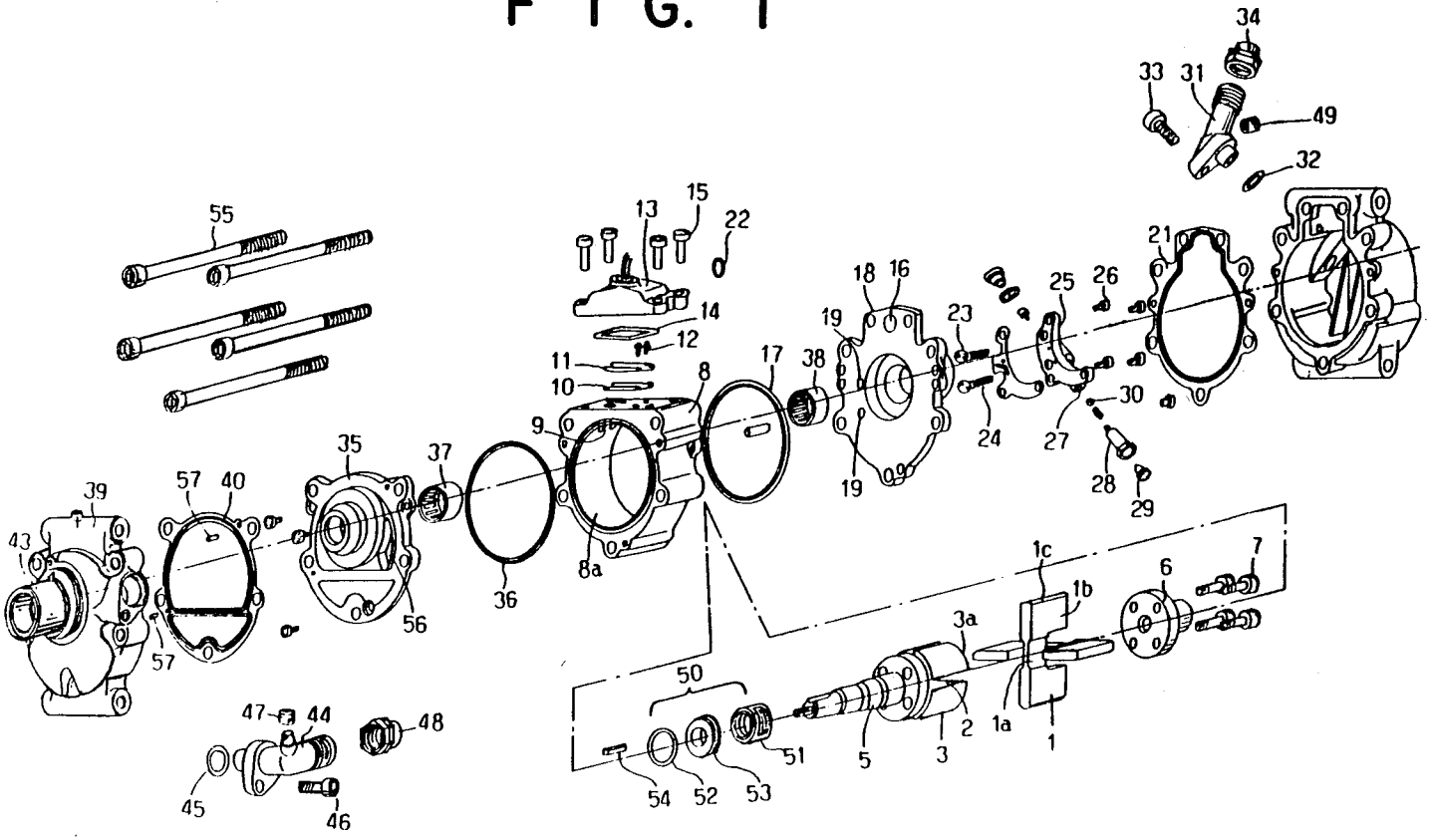
FIG. 1 is an exploded perspective view showing the several parts which may be assembled to provide a rotary vane-type compressor embodying principles of the present invention.
Figure 4:
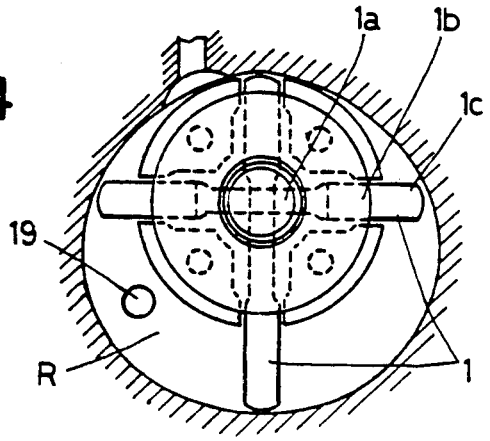
FIG. 4 is a transverse cross sectional view of the rotor assembly, taken along line 2—2 in FIG. 2.

In FIG. 1, reference numeral 5 designates a shaft portion, reference numeral 3 indicates a rotor made integrally with the shaft portion 5, e.g. of the steel alloy (SCr9) the coefficient of thermal expansion of which is approximately $12\times10^{-6}$. A set of cross-shaped vane grooves 2 (shown in FIG. 4) the length of which is as long as a longitudinal length (i.e. the thickness) of the rotor 3 is provided in the rotor 3. Reference numeral 1 indicates the vanes of a vane assembly comprising two C-shaped slide vane bodies, e.g. made of silicon-aluminum alloy, the coefficient of thermal expansion of which is approximately $18\times10^{-6}$. Two such slide vane bodies 1 are assembled to one another and slidably mounted in the vane groove 2 to provide four vanes. The thickness of the central portion 1*a* of each slide vane body is thinner than that of its two vane portions 1*b*. And each tip 1*c* is reduced in its thickness to be of a tapered shape.

Reference numeral 6 indicates a rotor cover attached to the end face 3*a* of rotor 3 and fixed by screws 7.

Figure 2:
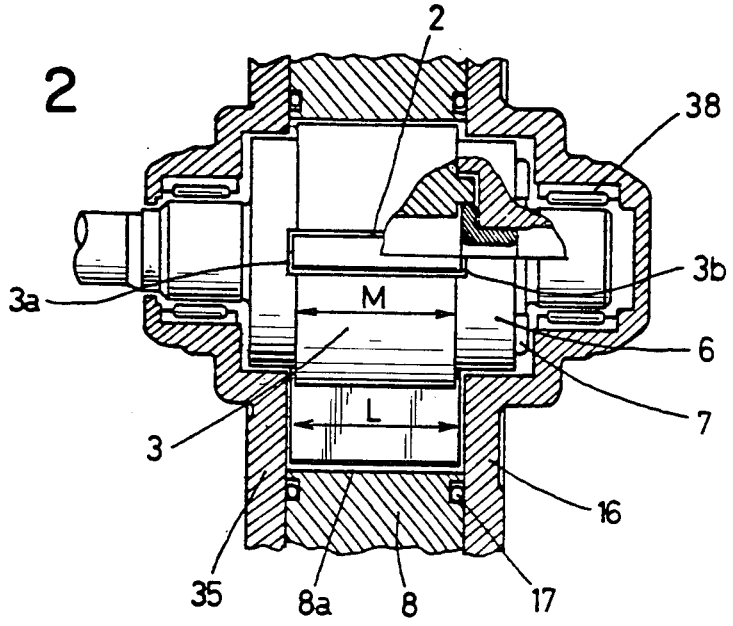
FIG. 2 is a longitudinal cross sectional view of the rotor assembly of a rotary vane-type compressor of the present invention.

The width L of each vane 1 (shown in FIG. 2) is 35 mm, for instance, and is approximate 0.05 mm shorter than the thickness M of the rotor 3 while they are under normal temperature e.g., about 20° C. And the width vane L becomes the same as the rotor thickness M when the temperature increases to e.g. about 120° C. If the temperature becomes higher than e.g. 120° C. the width L becomes to be longer than the thickness M because of the coefficient of thermal expansion of the vanes 1 being higher than that of the rotor 3.

Reference numeral 8 indicates a cylindrical housing wherein the rotor 3 is contained. The housing 8 may be made of the steel alloy (FCD 9) which is similar to the material of the rotor 3. A working chamber R is defined with the inner peripheral surface 8*a* of this housing 8, the outer peripheral surface of the rotor 3 and the side faces of the vanes 1. Reference numeral 9 designates a discharge port provided in the housing 8, the discharge port 9 being covered by a discharge valve 10. The discharge valve 10 and its cover 11 are shown fixed into the housing 8 by screws 12.

The discharge valve 10 is shown covered by a discharge chamber housing 13 which is shown fixed to the housing 8 via an elastic ring 14 by bolts 15. Reference numeral 16 designates a side plate, e.g. made of the cast steel (FCR) which preferably is made of the same kind of material that the rotor 3 is made of. The side plate 16 is fixed to the housing 8 via an O-ring 17. A discharge path connecting with a discharge chamber via an O-ring 22 and a venting port 19 connecting with the working chamber R are provided in the side plate 16. Also, a bearing 38 rotatably supporting the rotor cover 6 is mounted on the side plate 16.

Reference numeral 20 designates an oil separator housing attached to the side plate 16 through a gasket 21 and connecting with the discharge chamber 13*a* through the discharge path 18. A venting valve 23 and its keeping spring 24 are located in the venting port 19 and are held with a valve holder 25 by screws 26. The venting valve 23 keeps the working chamber R from being subjected to extraordinarily high pressure by such mode that the venting valve 23 opens the venting port 19 to permit the high pressure gas to escape towards the oil separator 20 when gas pressure in the working chamber R becomes higher than the predetermined pressure determined by the setting load of the spring 24. An oil path 27 connecting with a bottom portion of the oil separator via an oil pipe 28, an oil filter 29 and a check valve 30 are provided in the valve holder 25. Therefore, a lubricant oil from a sump in the bottom portion of the oil separator is pumped up into the oil path 27 by the pressure difference between the both ends of the oil path 27 and flows towards the end face 3*a* of the rotor 3.

Reference numeral 31 indicates a discharge pipe attached to the oil separator 20 through an O-ring 32 by a bolt 33. Reference numeral 49 indicates a cover cap of this discharge pipe 31, and reference numeral 49 notes a service valve. The discharge gas goes out through the discharge pipe 31 after the lubricant oil is separated in the oil separator 20.

Figure 3:
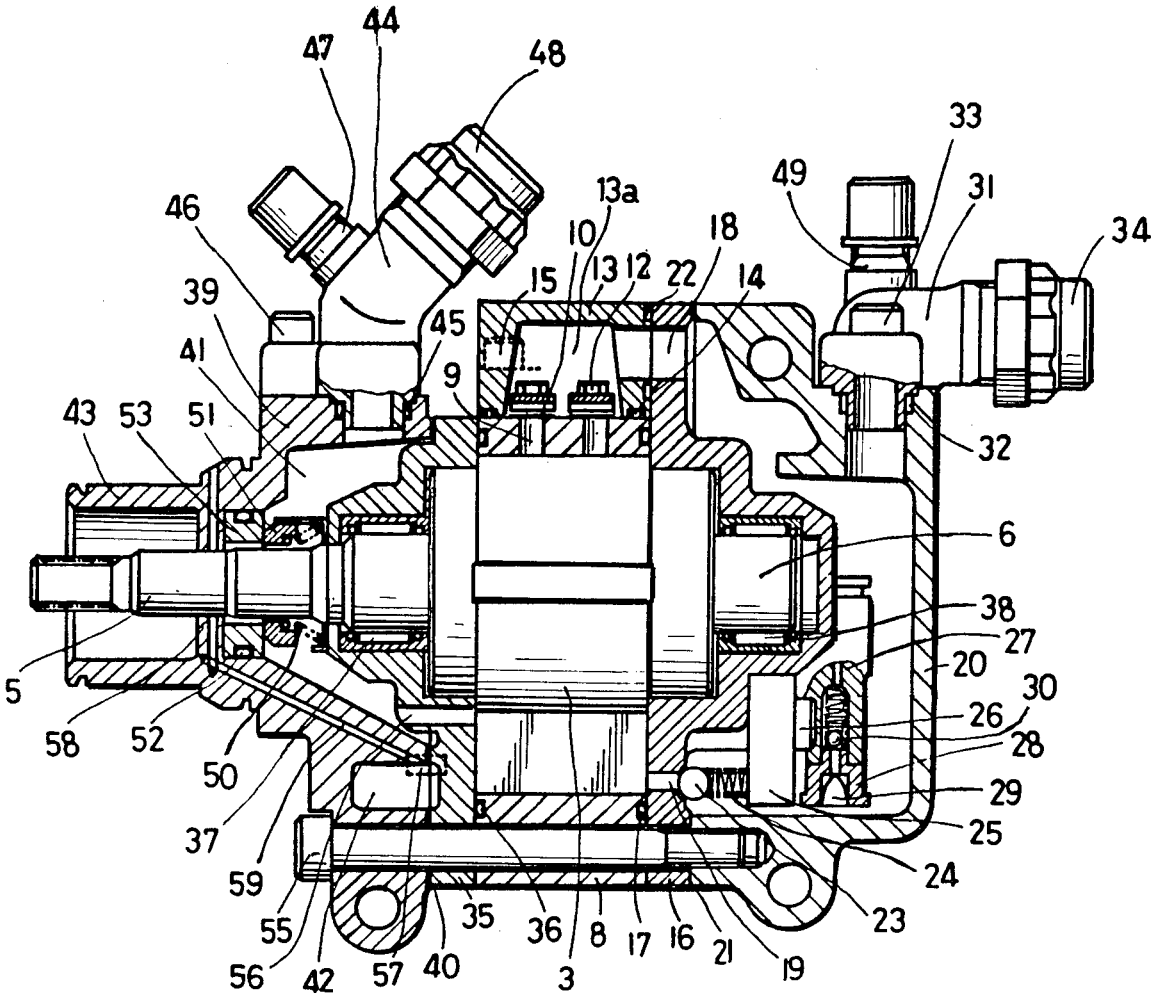
FIG. 3 is a longitudinal cross sectional view of the rotary vane-type compressor according to the present invention.

Reference numeral 35 designates a side plate, e.g. made of cast steel (FCR) which preferably is the same kind of metal as that of the rotor 3, is shown attached with the other end face of the housing 8 via an O-ring 36. A bearing 37 rotatably supporting the shaft portion 5 is mounted in the side plate 35. A suction port 56 connecting a suction chamber and the working chamber R also is provided in the side plate 35. A front housing 39 wherein the suction chamber 41 and a drain chamber 42 (shown in FIG. 3) are provided is attached to the side plate 35 via a gasket 40. A connecting pin 57 connects the gasket 40 in order to fit the gasket 40 with the side plate 35. A boss portion 43 whereon an electric clutch (not shown) is mounted, is provided at the outer surface of the front housing 39. A suction pipe 44 is attached into the front housing 39 via an O-ring 45 by a bolt 46. The suction pipe 44 is covered with a covering cap 48. Reference numeral 47 notes a suction service valve.

Reference numeral 50 indicates a shaft seal sealing between the outer surface of the shaft portion 5 and the inner surface of the front housing 39. The shaft seal 50 is shown comprising a rotating ring 51 constructed and arranged to rotate with the shaft 5, and a fixed ring 53 fixed to the housing 39 via an O-ring 52. The front housing, the gasket 40, the side plate 35, the housing 8, the side plate 16, the gasket 21 and the oil separator 20 are assembled with each other by bolts 55.

The operation of the rotary vane-type compressor assembled from the elements described above is explained in the following text.

When the electric clutch (not shown) transmits the rotary power of the automotive engine to the shaft portion 5, the shaft portion 5 and the rotor 3 supported by the bearings 37 and 38 begin to rotate within the inner surface 8*a* of the housing 8. Therefore, the volume of the working chamber R is increasing or decreasing in accordance with the rotation of the rotor 3. The coolant gas introduced from an evaporator (not shown) through the suction chamber flows into the working chamber R via the suction port 56 while the volume of the working chamber R is increasing. Then the coolant gas is compressed while the volume is decreasing and discharges into the discharge chamber 13*a* from the discharge port 9. After that the lubricant oil is separated from the coolant gas in the oil separator 20. Then, the coolant gas is discharged into a condensor (not shown) through the discharge pipe 31.

When condensed coolant liquid accumulates in the working chamber R, for instance at the beginning of rotation of the rotor 3, the pressure in the working chamber R comes to be at an extreme high after the rotor 3 is rotated. The compressor of this embodiment, however, has the venting valve 23 which permits the extreme high pressure coolant to escape. Therefore, destruction of the vane 1 caused by extreme high pressure is successfully avoided.

Furthermore, the compressor of this embodiment preferably has a specially designed vane 1. Namely, the width L of the vane 1 is shorter than the thickness (longitudinal dimension) M of the rotor 3 when the temperature thereof is less than its normal, steady state working temperature and the width L of the vane 1 becomes longer than the thickness M of the rotor 3 when the temperature thereof is high. Accordingly, in order to prohibit longitudinal movement of the rotor 3, the side plates 35 and 16 are contacted with both end faces 3*a* and 3*b* of the rotor 3 when the temperature is below normal and contacted with the both end faces of the vane 1 when the temperature becomes high. Therefore, the rotor 3 and the side plates 35 and 16, which are made of the same king of metal as each other, do not contact when the temperature thereof is high, in order to prevent deposition of material.

According to the compressor of this embodiment the lubricant oil sump in the bottom portion of the oil separator 20 supplies the end face of the rotor cover 6 via the oil path 27, then flows toward the outer surface of the rotor 3 and the bearing 37. Therefore, the bearings 37 and 38, the housing 8, and the shaft seal 50 are sufficiently supplied the lubricant oil.

A successful seal between the shaft portion 5 and the front housing 39 is obtained with the shaft seal 50. Even if lubricant oil leaks from the shaft seal 50, the leaked oil is interrupted by an oil trap 58 and then flows into the drain chamber 42 via a drain path 59. Therefore, according to the compressor of this embodiment, leaking of lubricant oil from the front housing 39 is completely protected against.

The compressor of above embodiment has a vane assembly 1 both ends of which are contacted with the inner surface 8*a* of the housing 8. However, divided vanes may be used instead of the through-vane structure shown.

The material of the rotor 3, the housing 8, the side plates 16 and 35 and the vanes 1 do not have to be made of steel and aluminum respectively. Other kinds of material, e.g., not only metal but also carbon plastic and ceramics, the coefficient of the thermal expansion of which is similar to one another within the rotor 3, the housing 8 and the side plates 16 and 35 and that of the vanes 1 is larger than the others may be used.

What is claimed is:

1. A rotary vane-type compressor, comprising:

housing means defining a closed cylindrical cavity with an inner peripheral surface and opposite ends;

means defining a refrigerant gas inlet to said cavity and a compressed refrigerant gas outlet from said cavity;

valve means interposed in said inlet and outlet for controlling flow of refrigerant gas to and from said cavity;

a rotor having an outer peripheral surface and axially opposite end surfaces, said rotor being provided in said outer peripheral surface with a plurality of radially outwardly opening slots, each of which extends from one end of the rotor to the other;

a set of vanes, each radiating from a respective said slot in said rotor and being movably mounted therein for variable radial projection outwardly of said outer peripheral surface of said rotor, each vane having a radially outer end;

a shaft journalled for rotation with respect to said housing means and sealingly extending axially into said cavity;

said rotor being eccentrically disposed in said cavity and mounted to said shaft to be rotated with said shaft with said vane ends in sliding contact with said inner peripheral surface of said cavity and dividing said cavity into a plurality of chambers;

said rotor being made of a material having a smaller coefficient of thermal expansion than that of the material of which said vanes are made;

said rotor and vanes being of such corresponding dimensions, axially of said cavity, that when said rotary vane-type compressor is operating at a preselected intermediate temperature, said corresponding dimensions are substantially equal and both said vanes and said ends of said rotor are in sliding contact with said housing means at opposite ends of said cavity, but when said rotary vane-type compressor is operating at a lower temperature said vanes are gapped from said housing means at at least one of said opposite ends of said cavity so that refrigerant gas in said cavity may escape from one said chamber to another said chamber between said vanes and said at least one end of said cavity, and when said rotary vane-type compressor is operating at a higher temperature said vanes protrude sufficiently beyond said axially opposite end surfaces of said rotor as to prevent said rotor from fusing to said housing means at said opposite ends of said housing.

2. The rotary vane-type compressor of claim 1, wherein:

said rotor includes four said slots and said set of vanes comprises two interfitted slide vane bodies crossing one another at right angles, each such body providing two of said vanes.

3. A rotary vane-type compressor, comprising:

a shaft portion constructed and arranged to be rotated by rotary power;

a cylindrically shaped rotor constructed and arranged to rotate with said shaft portion;

vane groove means provided in said rotor so as to extend fully longitudinally across said rotor;

vane means radially slidably located in said vane groove means;

the coefficient of thermal expansion of said vane means being greater than that of said rotor;

the width of said vane means, longitudinally of said rotor, being slightly shorter than the longitudinally-measured thickness dimension of said rotor while the temperature thereof is less than a predetermined normal steady-state operating temperature of said rotor and the width of said vane means being slightly greater than the thickness of said rotor when the temperature thereof becomes higher than said predetermined normal steady-state operating temperature;

a housing having a cylindrical cavity rotatably, eccentrically containing said rotor and defining a working chamber with an outer peripheral surface of said rotor and side surfaces of said vane means, and with a side plate made of the same kind of material as said rotor, said side plate forming a side of said housing and closing said cavity;

said rotor and said housing including said side plate thereof being made of steel and said vane means being made of an aluminum alloy.

4. A rotary vane-type compressor as defined in claim 3, wherein:

said width of said vane means is approximately 0.05 mm shorter than the corresponding said dimension of said rotor when the temperature thereof is about 20° C., said width of said vane means is approximately the same as the corresponding said dimension of said rotor when the temperature thereof is about 120° C., and said width of said vane means is longer than the corresponding said dimension of said rotor when the temperature thereof is higher than 120° C.

5. A rotary vane-type compressor as defined in claim 3, wherein:

said coefficient of thermal expansion of said rotor is approximately $12\times10^{-6}$ and that of said vane is approximately $18\times10^{-6}$.

6. A rotary vane-type compressor, comprising:

housing means defining a closed cylindrical cavity with an inner peripheral surface and opposite ends;

one of said ends of said housing means being defined by a side plate constructed and arranged for closing said one end;

a shaft portion sealingly extending axially into said cavity through said side plate and being constructed and arranged to be rotated about its own longitudinal axis;

a cylindrical rotor having an outer peripheral surface and two opposite ends, said rotor being disposed in said cylindrical cavity with said ends thereof facing corresponding said ends of said cylindrical cavity, and said outer peripheral surface of said rotor facing said inner peripheral surface of said housing means, said rotor being mounted to said shaft portion for rotation therewith;

vane grooves provided in said rotor so as to extend fully longitudinally of said rotor throughout at least two corresponding, diametrically opposed radially outer portions of said rotor and so as to extend fully diametrically of said rotor;

said outer peripheral surface of said rotor being of a smaller diameter than said inner peripheral surface of said housing means cavity, and said shaft portion having said longitudinal axis thereof disposed parallel to but laterally displaced from the longitudinal axis of said inner peripheral surface of said housing means cavity, whereby said rotor is arranged eccentrically with respect to said cavity;

vane means diametrically slidably located in said vane groove means with both opposite radially outer ends thereof juxtaposed with said radially inner peripheral surface of said housing means cavity and with both longitudinally opposite ends thereof juxtaposed with corresponding opposite ends of said housing means cavity within where said vane groove means extends fully longitudinally of said rotor, so that said vane means divides said cavity into at least two angularly adjacent working chambers;

said rotor and said housing means including said side plate all being made of materials having substantially equal coefficients of thermal expansion, but said vane means being made of a material having a greater coefficient of thermal expansion longitudinally of said housing means;

said vane means being constructed and arranged to be of a width, longitudinally of said housing means, which:

(a) substantially equals the corresponding thickness dimension of said rotor, longitudinally of said housing means, only when said rotary vane-type compressor is operating at a predetermined steady-state condition at which said rotor is too cool to fuse to said side plate, (b) is shorter than said corresponding thickness dimension only when said rotary vane-type compressor is operating at a lower temperature than at said steady-state condition, so as to permit some working fluid in said cavity to flow from one said working chamber to another said working chamber between said vane means and at least one said end of said housing means cavity, and (c) is longer than said corresponding thickness dimension only when said rotary vane-type compressor is operating at a higher temperature than at said steady-state condition, and protrudes beyond at least said end of said rotor which faces said end plate, so as to prevent said rotor from fusing to said end plate when said rotor is otherwise hot enough to fuse to said end plate.

* * * * *